US005943035A

United States Patent [19]

Katakura

[11] Patent Number: 5,943,035

[45] **Date of Patent: *Aug. 24, 1999**

[54] DRIVING METHOD AND APPARATUS FOR LIQUID CRYSTAL DEVICE

[75] Inventor: Kazunori Katakura, Atsugi, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/425,472

[22] Filed: Apr. 20, 1995

[30] Foreign Application Priority Data

Apr. 20, 1994 [JP] Japan ..... 6-104377

[51] Int. Cl.[6] ..... G09G 3/36

[52] U.S. Cl. ..... 345/97; 345/89

[58] Field of Search ..... 345/97, 98, 89

[56] References Cited

U.S. PATENT DOCUMENTS

| | | | |
|---|---|---|---|
| 4,367,924 | 1/1983 | Clark et al. | 350/334 |
| 4,639,089 | 1/1987 | Okada et al. | 350/341 |
| 4,857,906 | 8/1989 | Conner | 345/97 |
| 4,923,285 | 5/1990 | Ogino et al. | 345/97 |
| 5,120,466 | 6/1992 | Katagiri et al. | 252/299.01 |
| 5,172,107 | 12/1992 | Kanno et al. | 345/100 |
| 5,189,536 | 2/1993 | Hanyu et al. | 345/97 |
| 5,262,082 | 11/1993 | Janulis et al. | 252/299.01 |
| 5,321,419 | 6/1994 | Katakura et al. | 345/97 |
| 5,345,250 | 9/1994 | Inove et al. | 345/98 |
| 5,408,246 | 4/1995 | Inaba et al. | 345/89 |
| 5,440,412 | 8/1995 | Mouri et al. | 345/96 |
| 5,521,727 | 5/1996 | Inaba et al. | 345/97 |
| 5,532,713 | 7/1996 | Okada et al. | 345/97 |
| 5,543,817 | 8/1996 | Inove et al. | 345/98 |

FOREIGN PATENT DOCUMENTS

| | | |
|---|---|---|
| 56-107216 | 8/1981 | Japan . |
| 1160986 | 6/1989 | Japan . |
| 1193390 | 8/1989 | Japan . |
| 04043321 | 2/1992 | Japan . |

*Primary Examiner*—Amare Mengistu
*Assistant Examiner*—Ricardo Osorio
*Attorney, Agent, or Firm*—Fitzpatrick, Cella, Harper & Scinto

[57] ABSTRACT

A liquid crystal device including a chiral smectic liquid crystal disposed in a bistable alignment state including a first and a second stable state showing an asymmetrical threshold characteristic can be driven for a binary display according to a matrix drive scheme with an improved drive margin. The liquid crystal device is driven so that the liquid crystal is first reset into a less-stable first state regardless of display data and then selectively switched into a more-stable second state depending on given gradation data. The chiral smectic liquid crystal may be disposed in a planar smectic layer structure free from bending.

7 Claims, 11 Drawing Sheets

DRIVING METHOD AND APPARATUS FOR LIQUID CRYSTAL DEVICE

FIELD OF THE INVENTION AND RELATED ART

The present invention relates to a driving method and apparatus for a liquid crystal device for use in a computer display, a video camera view finder, a light valve for a projector, a television receiver display, a navigation system display, a light valve for a liquid crystal printer, etc., particularly such a liquid crystal device using a chiral smectic liquid crystal.

A display device of the type which controls transmission of light in combination with a polarizing device by utilizing the refractive index anisotropy of liquid crystal molecules in chiral smectic phase, has been proposed by Clark and Lagerwall (Japanese Laid-Open Patent Application (JP-A) 56-107216, U.S. Pat. No. 4,367,924, etc.). The chiral smectic liquid crystal used in such a display device has generally chiral smectic C phase (SmC*) or H phase (SmH*) or a non-helical structure in a specific temperature range and, in the SmC* or SmH* phase, shows a property of assuming either one of a first optically stable state and a second optically stable state responding to an electrical field applied thereto and maintaining such a state in the absence of an electrical field, namely bistability, and also has a quick responsiveness to the change in electric field. Thus, it is expected to be widely utilized in a high speed and memory type display device and particularly to provide a large-area, high resolution display according to a simple matrix drive scheme in view of its function.

For an optical modulating device using a chiral smectic (ferroelectric) liquid crystal having such bistability to exhibit desirable driving characteristics, it is important that the liquid crystal disposed between a pair of substrates should be in such a molecular alignment state that switching between the above two stable states may occur stably and at a good reproducibility, and the alignment state is homogeneous at a pixel and over the entire display area.

In order to align the ferroelectric liquid crystal, it has been generally practiced to use a pair of substrates each surfaced with a film of a polymer, such as polyimide (PI), polyvinyl alcohol (PVA) or a polyamide (PA), having a homogeneous (or oblique) alignment characteristic, so that the substrates are rubbed in almost identical directions.

In the above case, a liquid crystal showing a phase transition series on temperature decrease of isotropic (Iso), cholesteric (Ch=chiral nematic (N*)), smectic A (SmA) and SmC*, is allowed to assume a homogeneous alignment in the Ch phase, so that the liquid crystal also tends to assume a homogeneous alignment in SmC* phase. Liquid crystal devices using such a liquid crystal having a phase series including Ch phase have been disclosed in U.S. Pat. Nos. 4,639,089 and 5,120,466.

On the other hand, in case of using a liquid crystal showing a phase transition series on temperature decrease of Iso phase, SmA phase and SmC* phase, there are required steps of generation, growth and combination of batonnets (a kind of liquid crystal nuclei) at the time of Iso phase→SmA phase transition (I/A transition), so that defects such as a deviation in smectic layer normal direction and defects at the connections of batonnets are liable to occur, thus obstructing ready formation of a homogeneous alignment.

Such a liquid crystal lacking Ch phase can be homogeneously aligned by rubbing only one of opposing substrates and subjecting the other non-rubbing substrate to a homeotropic aligning treatment. As a result, the liquid crystal is grown from the rubbed substrate surface in the vicinity of the I/A transition temperature to reach the opposite substrate. I have confirmed the above fact by confirming the phenomenon that the I/A transition temperature in a cell having homogeneous alignment films on both substrates is higher by more than 0.5° C. than that in a cell having both substrates subjected to a homeotropic aligning treatment.

As described above, in order to align a ferroelectric liquid crystal, particularly one lacking Ch phase, it has been found effective to use an asymmetrical structure including a substrate having a rubbed homogeneous alignment film and a substrate subjected to a homeotropic aligning treatment (as discussed in U.S. Pat. appln. Ser. No. 08/283,141, filed Aug. 1, 1994 and entitled "Liquid Crystal Device").

However, in the homogeneous alignment obtained in the above-described manner, the bistability of a ferroelectric liquid crystal can be impaired due to different surface properties on the opposite substrates, thus being liable to provide an asymmetrical electrooptical switching characteristic (threshold characteristic).

JP-A 4-43321 has proposed a driving method for a liquid crystal device having such an asymmetrical switching characteristic, wherein all the pixels are reset into a first stable state (initialized) in a liquid crystal device having such a threshold characteristic of Va>Vb, wherein Va denotes a threshold for switching liquid crystal molecules from the first stable state to a second stable state, and Vb denotes a threshold for switching liquid crystal molecules from the second stable state to the first stable state.

An attempt was made to drive a liquid crystal device containing a liquid crystal material having the above-mentioned phase series lacking Ch phase according to a multiplexing drive scheme using drive signals as described hereinafter. It was however impossible to obtain a sufficient margin for setting of drive voltages. This may partly be attributable to the fact that a different liquid crystal material and different drive signals not disclosed in the above JP-A 4-43321 were used in combination.

On the other hand, U.S. Pat. Appln. Ser. No. 08/099,054 (filed Jul. 29, 1993) has disclosed a drive scheme for a liquid crystal device having a threshold characteristic of Va<Vb (i.e., opposite to the one used in JP-A 4-43321) wherein all the pixels are reset to a first stable state. The liquid crystal device driven by the above scheme is one including pixels each having a threshold distribution for gradational display and is not suitable for binary display providing bright (white) and dark (black) display states. The device is further insufficient in respect of contrast, and a further improvement is desired.

SUMMARY OF THE INVENTION

An object of the present invention is to provide a driving method for a liquid crystal device capable of providing a high contrast.

Another object of the present invention is to provide a driving method for driving a liquid crystal device having an asymmetrical threshold characteristic with a broader drive margin during matrix drive so as to allow a good display over the entire display area.

According to the present invention, there is provided a driving method for a binary display-type liquid crystal device comprising an electrode matrix including a group of scanning electrodes and a group of data electrodes and a chiral smectic liquid crystal disposed between the scanning electrodes and the data electrodes so as to form a pixel at each intersection of the scanning electrodes and the data electrodes; said liquid crystal being aligned to assume two stable states corresponding to a bright state and a dark state of each pixel and having a threshold characteristic of Va<Vb, wherein Va denotes an electric field intensity of one polarity required for switching from a first stable state to a second stable state, and Vb denotes an electric field intensity of the polarity required for switching from the second stable state to the first stable state; said driving method comprising:

sequentially applying a scanning selection signal to the scanning electrodes, and applying data signals based on display data to the data electrodes in synchronism with the scanning selection signal; wherein said scanning selection signal includes a clearing pulse for resetting the liquid crystal to a first stable state regardless of given display data, and a selection pulse for switching the liquid crystal to the second stable state selectively depending on given display data; said clearing pulse being free from AC component during one selection period for a scanning electrode.

According to another aspect of the present invention, there is provided a driving method for a binary display-type liquid crystal device comprising an electrode matrix including a group of scanning electrodes and a group of data electrodes and a chiral smectic liquid crystal disposed in a planar smectic layer structure between the scanning electrodes and the data electrodes so as to form a pixel at each intersection of the scanning electrodes and the data electrodes; said liquid crystal being aligned to assume two stable states corresponding to a bright state and a dark state of each pixel and having a threshold characteristic of Va<Vb, wherein Va denotes an electric field intensity of one polarity required for switching from a first stable state to a second stable state, and Vb denotes an electric field intensity of the other polarity required for switching from the second stable state to the first stable state; said driving method comprising:

sequentially applying a scanning selection signal to the scanning electrodes, and applying data signals based on display data to the data electrodes in synchronism with the scanning selection signal; so that the liquid crystal is first reset into the first stable state regardless of given display data and then selectively switched to the second stable state depending on given display data.

It is preferred that the scanning selection signal includes a clearing pulse for resetting the liquid crystal to a first stable state regardless of given display data, and a selection pulse for switching the liquid crystal to the second stable state selectively depending on given display data, and optionally a first auxiliary pulse having the same polarity as the clearing pulse and an amplitude layer than that of a data signal, and a second auxiliary signal having the same polarity as the selection pulse and an amplitude smaller than that of a data signal; and that the clearing pulse is free from AC component during one selection period for a scanning electrode.

It is further preferred that the scanning electrodes and data electrodes are disposed on a pair of substrates, respectively, one of the substrates is subjected to a non-uniaxial aligning treatment, and the other of the substrates is provided with an alignment film subjected to a uniaxial aligning treatment; and that the chiral smectic liquid crystal has a phase transition of isotropic, smectic A and chiral smectic, successively, on temperature decrease.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The liquid crystal device used in the present invention has an asymmetrical threshold characteristic, which will be described with reference to FIG. 1.

Figure 1:
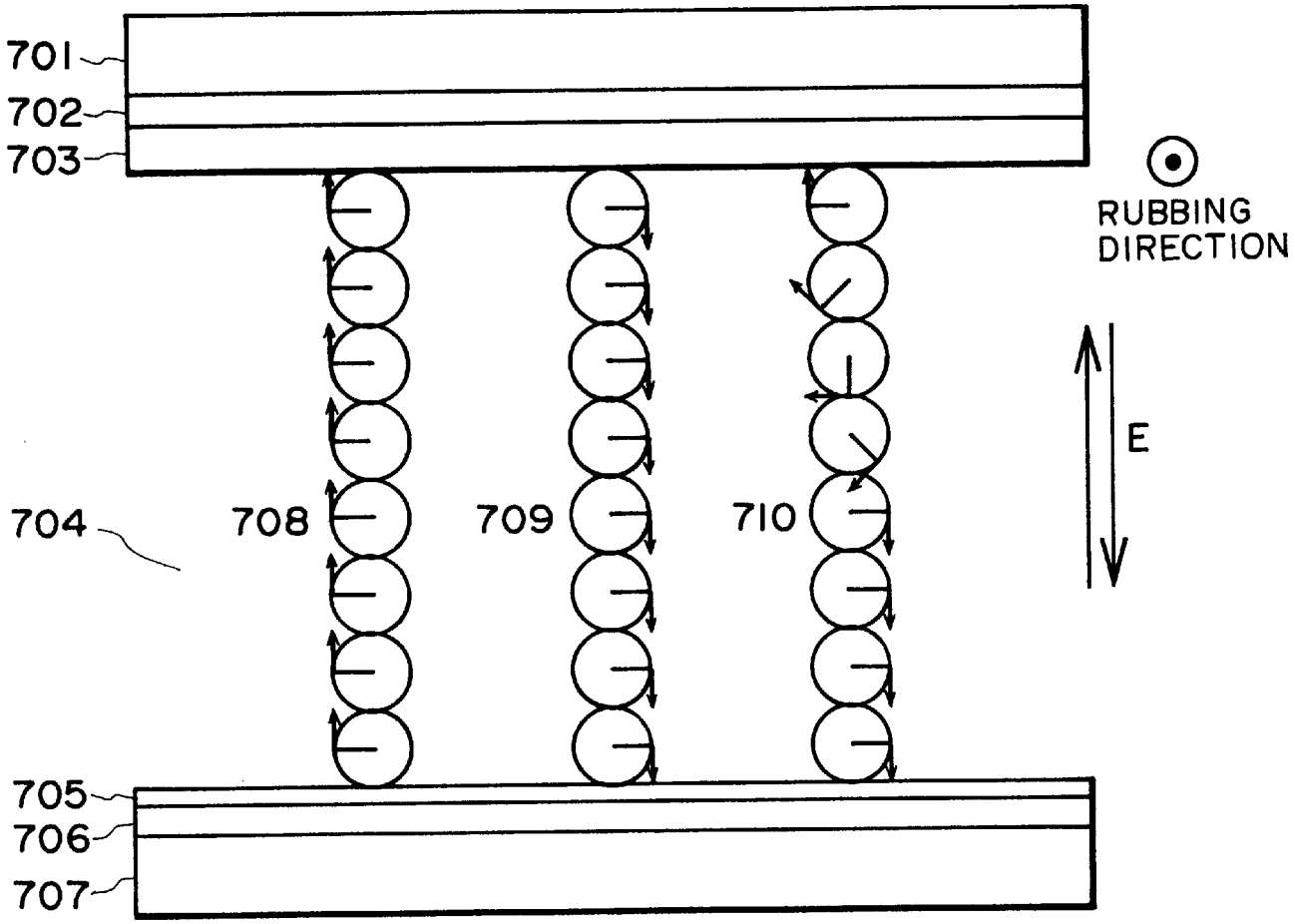
FIG. 1 is a schematic illustration of an alignment state of a liquid crystal.

FIG. 1 illustrates a model of liquid crystal alignment state in a device including opposing substrates having different surface states. Referring to FIG. 1, reference numerals 701 and 707 denote glass substrates; 702 and 706, transparent electrodes of ITO, etc.; 703, a rubbed polymer film having a homogeneous alignment capability; 704, a layer of ferroelectric liquid crystal; 705, a homeotropic aligning agent layer; and 708, 709 and 710 illustrate projections of chiral smectic liquid crystal molecules (C-directors) onto a cone bottom (represented by circle) together with dipole moments represented by arrows wherein 708 and 709 represent two stable states in a uniform alignment state, and 710 represents a splay alignment state Herein, the stable state denoted by 708 is called U2, and the stable state denoted by 709 is called U1 for convenience.

In case of using a film of polyimide, etch, as the polymer film 703, because of an electrical interaction (dipole-dipole interaction) acting between the dipole moment (represented by an arrow on a liquid crystal cone) and the polymer surface, such a controlling force is assumed to act so that the arrows are directed (outwardly) toward the alignment film 703 side. On the other hand, the controlling force acting on the liquid crystal molecules from the homeotropic aligning agent 705 side can be ignored, so that the state U2 (708) wherein the liquid crystal dipole moments are directed toward the alignment film 703 side is more stable.

On the other hand, the state U1 (709) wherein the liquid crystal dipole moments are directed toward the inside of the liquid crystal (inwardly), is against the control force of the alignment film 703 and is therefore less stable than the state U2 (708).

Accordingly, when switching between the two stable states is performed by application of an external electric field, thresholds are different for the switching from U1 to U2 and for the switching from U2 to U1, thus showing an asymmetrical threshold characteristic. In case of a certain combination of an alignment film and a liquid crystal material used, it is possible that the U2 state is not switched to the U1 state but is converted into a splay alignment state as shown at 710.

When a ferroelectric liquid crystal device having such an asymmetrical threshold characteristic is driven by an electrode matrix comprising scanning electrodes and data electrodes, it becomes difficult in some cases to effect a satisfactory display because the drive margin, i.e., the range of pulse amplitude or pulse width, allowing a matrix drive, becomes narrow.

Figure 2:
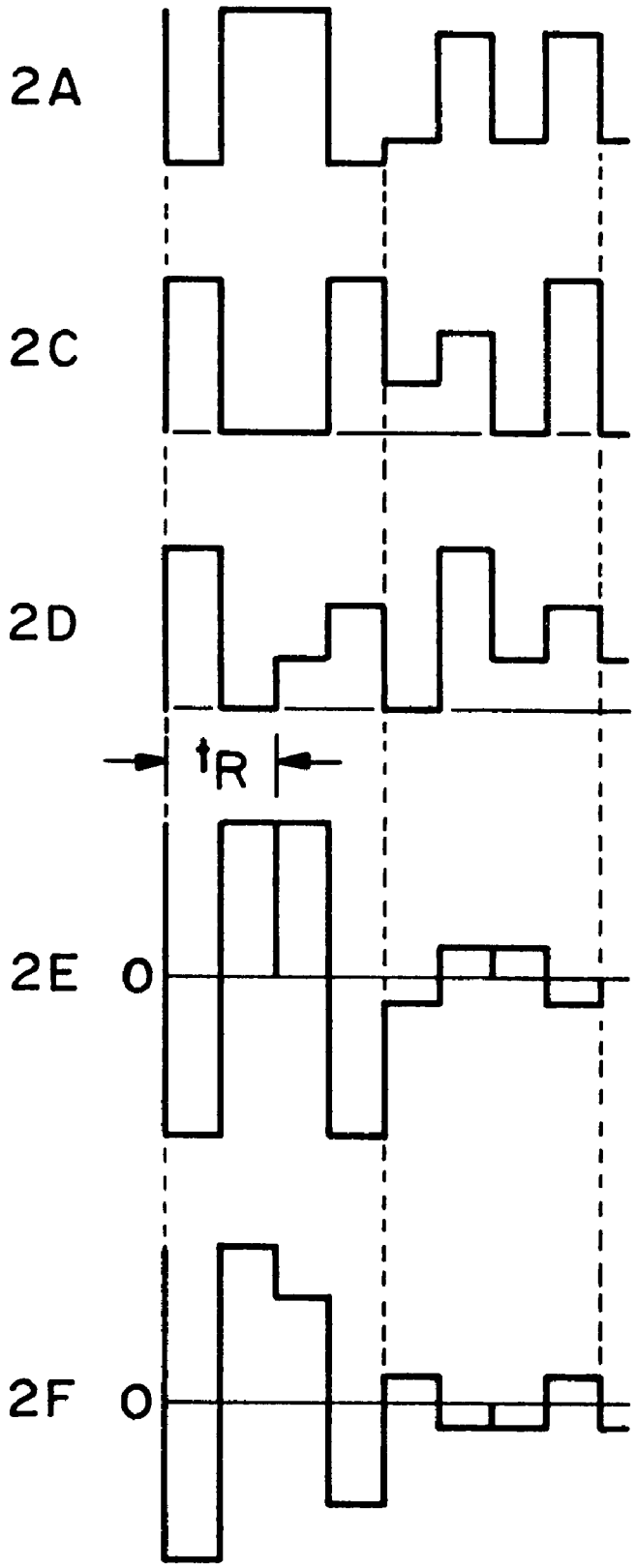
FIG. 2 is a time serial waveform diagram showing conventional drive signals.

FIG. 2 is a time chart showing an example set of drive signals as disclosed by JP-A 4-43321. Referring to FIG. 2, at 2A is shown a signal applied to a scanning line; at 2C and 2D are shown signals applied to data lines for providing different display states; at 2E is shown a signal formed by combination of the signals at 2A and 2C; and at 2F is shown a signal formed by combination of the signals at 2A and 2D. A period $t_R$ shown at 2E is a reset period and corresponds to one horizontal scanning period. It is to be noted that the DC components of the combined signals at 2E and 2F in the reset period are respectively zero.

Figure 3:
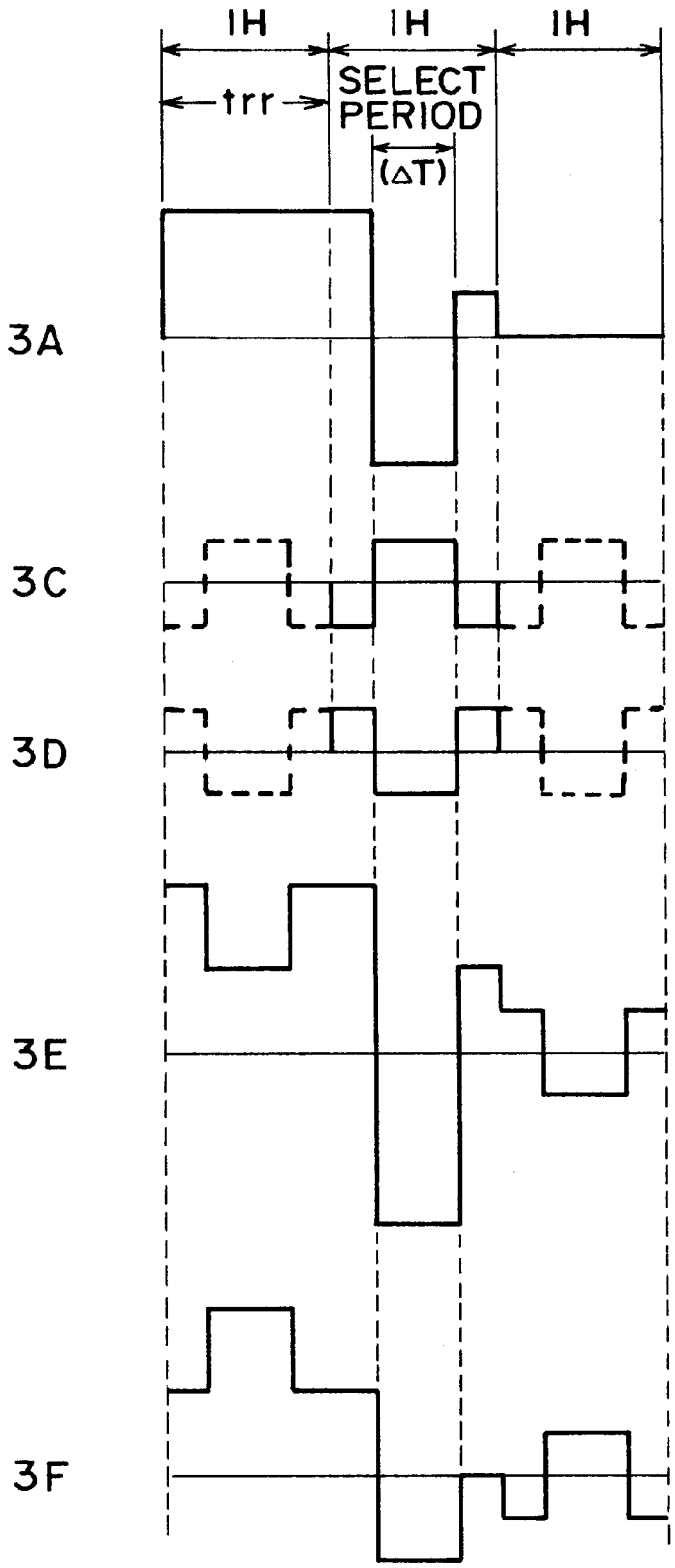
FIG. 3 is a time signal waveform diagram showing drive signals used in the Embodiment appearing hereinafter.

On the other hand, FIG. 3 is a time chart showing an example set of drive signals used in an embodiment of the present invention. Referring to FIG. 3, at 3A is shown a signal applied to a scanning line; at 3C and 3D are shown signals applied to data lines; and at 3E and 3F are signals obtained by a combination of the signals at 3A and 3C and a combination of the signals at 3A and 3D, respectively It is to be noted that the DC components of the combined signals at 3E and 3F applied for resetting or clearing pixels are not zero in one horizontal scanning period 1H (or reset period trr).

Figure 4A:
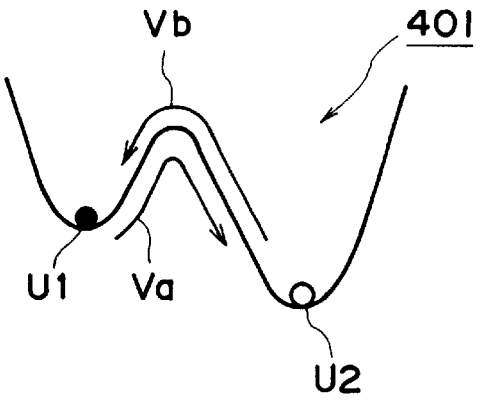
FIGS. 4A and 4B are schematic views illustrating the liquid crystal molecule states.
Figure 4B:
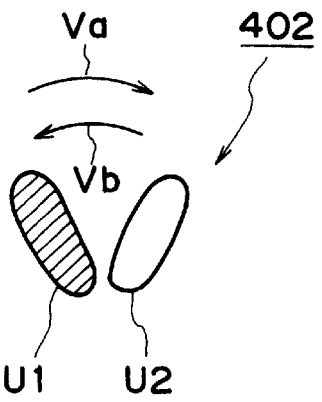

FIGS. 4B and 4A are schematic views for illustrating two stable states U1 and U2 of a liquid crystal molecule shown at 402 and a potential distribution for the states shown at 401. Herein, a threshold for switching from the first state U1 to the second state U2 is denoted by Va and a threshold for a reverse switching is denoted by Vb. In the case of FIGS. 4A and 4B, a relationship of Va<Vb stands.

In the case of resetting by using a signal with a DC component of zero as shown in FIG. 2, it has been considered preferable to effect a resetting for orienting liquid crystal molecules to the second state U2. However, in the case of resetting by using a signal with a non-zero DC component as shown in FIG. 3, it has been found preferable to effect a resetting in a reverse direction for orienting liquid crystal molecules to the first state U1.

Particularly, in a liquid crystal device using a liquid crystal in a small pretilt state or a liquid crystal lacking Ch phase and aligning the liquid crystal in a planar smectic layer structure, such as a so-called bookshelf structure, free from bending as in a so-called chevron structure, the resetting into the first state U1 stabilizes the liquid crystal behavior and provides a broader drive margin.

Hereinbelow, the structure of a liquid crystal device will be described.

Figure 5:
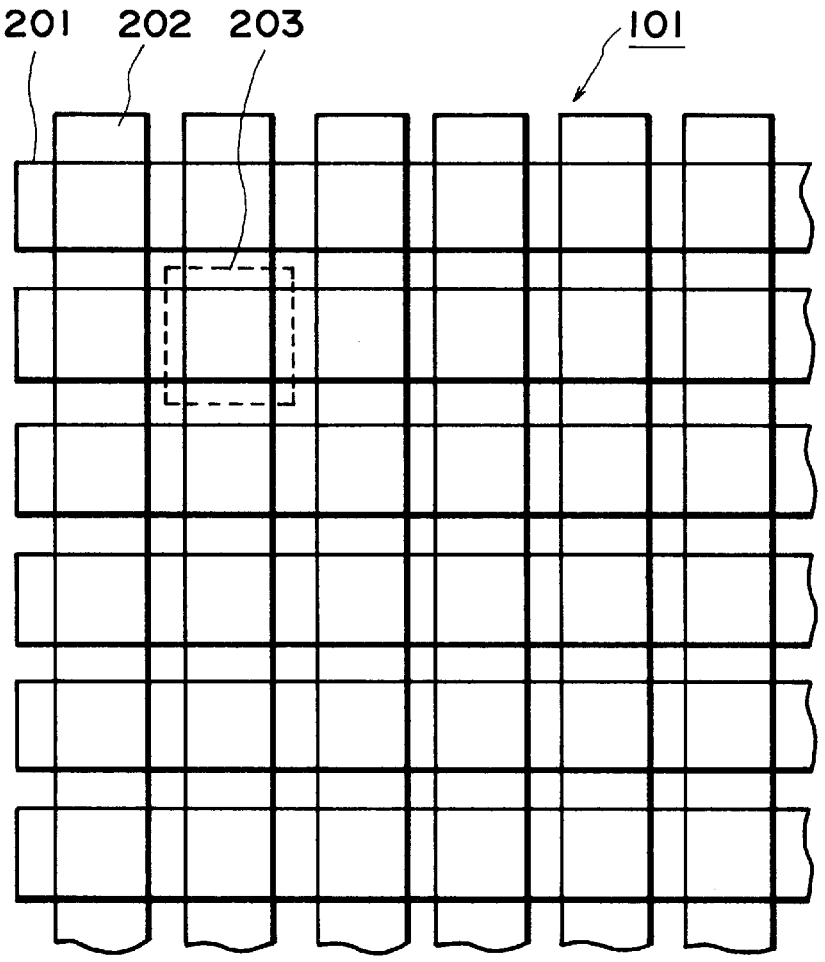
FIG. 5 is an enlarged schematic plan view of a display device 101 according to the present invention.

FIG. 5 is an enlarged partial plan view of a liquid crystal device (panel) 101. Referring to FIG. 5, the liquid crystal device includes a plurality of scanning electrodes 201, a plurality of data electrodes 202 intersecting with and forming an electrode matrix together with the scanning electrodes 201 so as to form a pixel (display element) at each intersection of the scanning electrodes 201 and the data electrodes 202.

Figure 6:
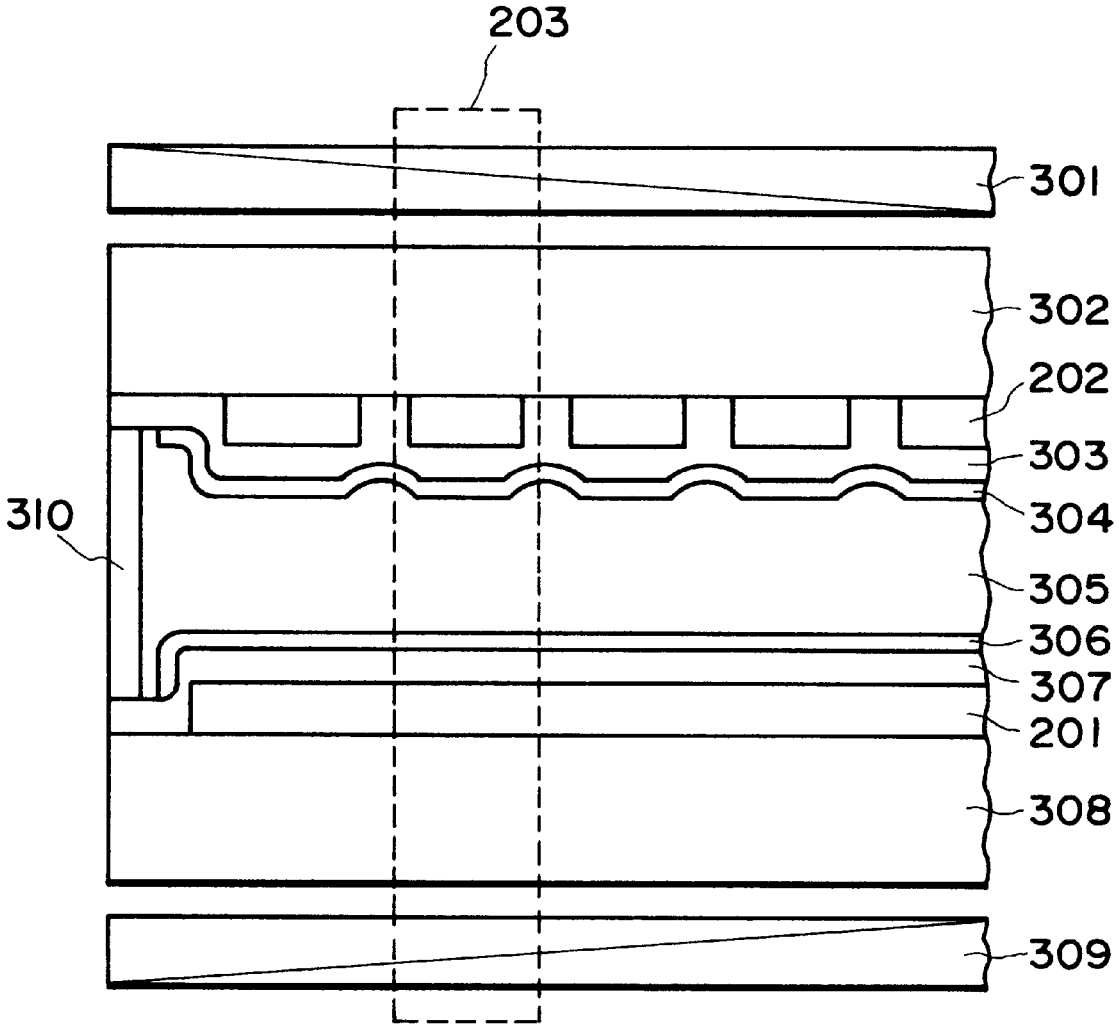
FIG. 6 is a partial sectional view of the liquid crystal device 101.

FIG. 6 is a partial sectional view of the liquid crystal device 101. Referring to FIG. 6, the liquid crystal device includes an analyzer 301 and a polarizer 309 sandwiching a cell structure which comprises substrates 302 and 308 having thereon insulating films 303 and 307 and alignment films 304 and 306, and a ferroelectric liquid crystal 305 disposed between the substrates 302 and 308 and within a cell structure defined by a sealing member 310.

In the above structure, the respective pixels may be provided with color filters of red (R), green (G) and blue (3) and optionally clear (W) so as to provide a multi-color display apparatus.

The substrates 302 and 308 may preferably comprise a transparent insulating material, such as glass, quartz and plastic As an inexpensive substrate, it may be preferred to use a blue sheet glass (soda glass) coated with silicone oxide.

The scanning electrodes 201 and data electrodes 202 may preferably comprise a transparent oxide conductor, such as $SnO_2$, ITO or InO. It is also possible to dispose a thin stripe of a low-resistivity conductor, such as Al, Mo, Ta or Cr, as desired, along an edge of each transparent conductor stripe The insulating films 303 and 307 may be disposed as desired and may preferably comprise an inorganic insulating material such as $SiO_2$, SiN, TaO or AlO.

One of the alignment films 304 and 306 is formed as a uniaxial alignment film or a homogeneous alignment film formed, e.g., through rubbing. And the other one may be formed as a non-uniaxial (non-homogeneous) alignment film. As a results of such an asymmetrical alignment characteristic provided to a pair of substrates, a good bookshelf alignment structure may be formed even by using a liquid crystal material having a phase series lacking Ch phase.

Examples of liquid crystal materials suitably used in the present invention may include a liquid crystal composition comprising a naphthalene-type mesomorphic compound and a pyrimidine-type mesomorphic compound; a liquid crystal composition comprising an achiral fluorine-containing mesomorphic compound having a fluorocarbon terminal portion and a hydrocarbon or another fluorocarbon terminal portion, and at least one chiral dopant; and also a liquid crystal composition comprising a dimer-type mesomorphic compound as used in Embodiment appearing hereinafter.

Among these compositions, a liquid crystal composition having a phase series lacking Ch phase can be relatively easily produced and is expected to provide a liquid crystal device which is inexpensive but shows a good switching characteristic when combined with the driving method according to the present invention.

Details of the above-mentioned mesomorphic compounds will be known from JP-A 1-193390, U.S. Pat. No. 5,262,082 and JP-A 1-160986.

It is particularly preferred to use a liquid crystal composition showing as small a difference as possible between a minimum smectic layer spacing in the vicinity of a phase transition temperature from SmA phase to SmC* phase and a minimum smectic layer spacing in SmC* phase by appropriate adjustment of mixing ratios of the respective compounds.

In case of preparing a liquid crystal device by using a liquid crystal composition as described above, it is preferred to apply an asymmetrical aligning treatment to the inner surfaces of the pair of substrates so as to provide different Iso - SmA phase transition temperatures to the boundaries between the liquid crystal and the inner surfaces of the substrates, thereby causing a preferential phase transition from one boundary side. For the uniaxial aligning treatment, rubbing or oblique..evaporation may be used, and such a uniaxial aligning treatment may preferably be omitted for the non-uniaxial aligning treatment.

More specifically, one substrate inner surface may be provided with a film of an organic material, such as polyimide, polyamide, polyvinyl alcohol or nylon, followed by rubbing, and the other substrate inner surface may be provided with such an organic film but without rubbing to provide a non-rubbing substrate.

Alternatively, it is also possible to provide one substrate with an obliquely vapor-deposited film of an inorganic material such as silicon oxide and provide the other substrate with an organic film as described above without rubbing.

The other substrate may also be provided with a non-uniaxial aligning treatment by applying a homeotropic aligning agent, such as a silane coupling agent.

A blank cell comprising such a pair of substrates subjected to an asymmetrical aligning treatment may be filled with a liquid crystal composition as described above heated into isotropic phase, followed by gradual cooling through SmA phase into SmC* phase.

It is preferred to control a temperature distribution in the cooling apparatus so that the substrate subjected to the uniaxial aligning treatment has a lower temperature than the other substrate.

Further, if the pretilt angle is suppressed to at most 5 degrees on the substrate subjected to the uniaxial aligning treatment by adjusting the intensity and number of rubbing operations in combination with an alignment film material used, it is possible to suppress the occurrence of defects and provide an appropriate asymmetry of threshold.

As described above, in the liquid crystal device used in the present invention, the ferroelectric liquid crystal 305 is placed in an alignment state providing two stable states including a first stable state and a second stable state showing an asymmetrical threshold characteristic of Va<Vb (wherein Va: an electric field intensity of one polarity required for switching from the first stable state to the second stable state, and Vb: an electric field intensity of the other polarity for switching from the second stable state to the first stable state). Such an asymmetrical threshold characteristic may for example be provided by subjecting one of the alignment films 304 and 306 to a homeotropic aligning treatment and the other to a homogeneous (uniaxial) aligning treatment so as to uniformly aligning a liquid crystal lacking Ch phase.

Next, the function of the driving method according to the present invention will be described with reference to the first stable state (U1) and the second stable state (U2).

Figure 7A:
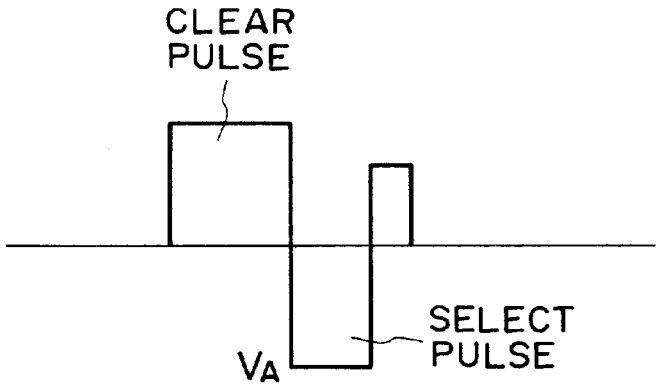
FIGS. 7A–7C are diagrams illustrating waveforms for examining the threshold characteristic of a liquid crystal device.
Figure 7B:
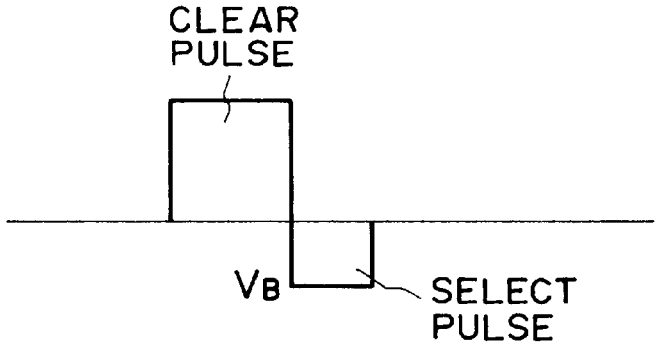
Figure 7C:
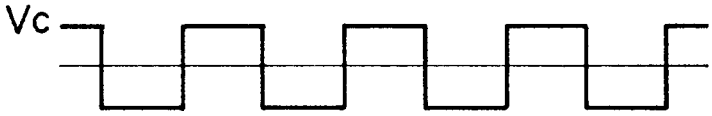

A series of experiments was conducted wherein a liquid crystal display device having an asymmetrical alignment characteristic was driven by applying drive signals as shown in FIGS. 7A–7C while changing voltage values $V_A$, $V_B$ and $V_C$ in the drive signals so as to examine a relationship between the drive waveforms and the resultant asymmetrical threshold characteristic.

Figure 8:
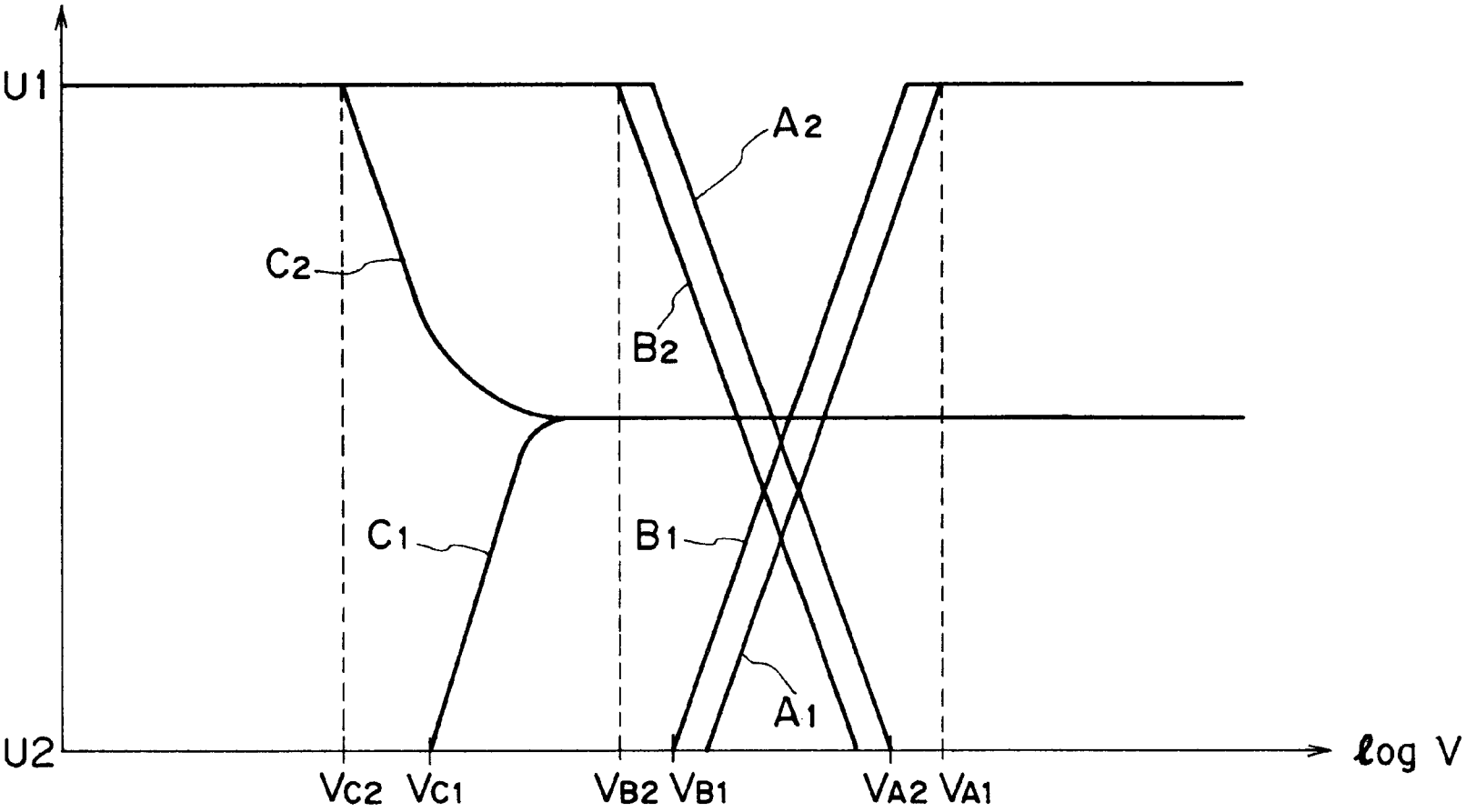
FIG. 8 is a diagram showing an asymmetrical threshold characteristic of a liquid crystal device.

FIG. 8 shows an example of threshold characteristic obtained by the above experiments Referring to FIG. 8, a curve A2 represents a case where the waveform of FIG. 7A was applied to once form U1 state by the clear pulse and then form U2 state by application of the selection pulse while changing the $V_A$ value of the selection pulse, a curve Al represents a case where the waveform of FIG. 7A was applied to once form U2 state by the clear pulse and then form U1 state by application of the selection pulse while changing the $V_A$ value of the selection pulse; a curve B2 represents a case where the waveform of FIG. 7 was applied to once form U1 state by the clear pulse and then form U2 state by application of the selection pulse while changing the $V_B$ value thereof; a curve B1 represents a case where the waveform of FIG. 7B was applied to once form U2 state by the clear pulse and then form U1 state by application of the selection pulse while changing the $V_B$ value thereof; a curve C2 represents a case where the device was first placed in state U1 and then supplied with the waveform of FIG. 7C while changing the $V_C$ value thereof; and a curve C1 represents a case where the device was first placed in U2 state and then supplied with the waveform of FIG. 7C while changing the $V_C$ value.

Further, in FIG. 8, $V_{A2}$ represents a selection pulse voltage at which U1 state was completely switched to U2 state by application of the waveform of FIG. 7A; $V_{A1}$ represents a selection pulse voltage at which U2 state was completely switched to U1 state by application of the waveform of FIG. 7A; $V_{B2}$ represents a selection pulse voltage at which U1 state began to be switched to U2 state by application of the waveform of FIG. 7B; $V_{B1}$ represents a selection pulse voltage at which U2 state began to be switched to U1 state by application of the waveform of FIG. 7B; $V_{C2}$ represents a voltage $V_C$ at which U1 state began to be switched to U2 state by application of the waveform of FIG. 7C; and $V_{C1}$ represents a voltage $V_C$ at which U2 state began to be switched to U1 state by application of the waveform of FIG. 7C.

If the degree of asymmetry of threshold characteristic is substantially constant regardless of the shape of drive pulses, the relationship is represented as follows:

$$V_{A1}=\alpha V_{A2}, V_{B1}=\alpha V_B \text{ and } V_{C1}=\alpha V_{C2} \ldots \quad (1),$$

wherein $\alpha>1$. Further, when a relationship of $V_{B1}=\beta V_{C1}$ and $V_{A1}=\gamma V_{B1}$ . . . (2) is satisfied, a relationship of $V_{B2}=\beta V_{C2}$ and $V_{A2}=V_{B2}$ . . . (3) also holds true, wherein $\beta\geqq 1$ and $\gamma\geqq 1$.

Now, if the amplitude of a selection pulse of a scanning selection signal applied to a scanning electrode 201 of the display device 101 is denoted by Vcom and the amplitude of a selection pulse of a data signal applied to a data electrode 202 is represented by Vseg so as to provide pulse amplitudes $V_A$–$V_C$ shown in FIGS. 7A–7C as follows:

$$V_A=\text{Vcom}+\text{Vseg},\ V_B=\text{Vcom}-\text{Vseg},\ V_C=\text{Vseg} \ldots \quad (3),$$

then a relationship of $$V_A=V_B+2V_C \ldots \quad (4) \text{ holds}$$

In the matter of drive margin, it is required that the liquid crystal is inverted by a voltage $V_A$ and not inverted by a voltage $V_B$ or $V_C$. For example, in the case where the liquid crystal is placed in U2 state in advance, it is required that the liquid crystal is inverted to U1 state by $V_A$ and not inverted to U1 by $V_B$. Further, the liquid crystal should not be inverted into either U1 or U2 state regardless of whether it has been placed in U1 or U2 state. Thus, a relationship of:

$$V_A\geqq V_{A1},\ V_B\leqq V_{B1} \text{ and } V_C\leqq V_{C2} \ldots \quad (5)$$

should be satisfied.

From formulae (4) and (5), $$V_{A1} \leqq V_A \leqq V_{B1} + 2V_{C2} \ldots \quad (6)$$

Further, from Formulae (1),(2), (2') and (6), the following relationship is given:

$$\alpha\beta\gamma V_{C2} \leqq V_A \leqq (2+\alpha\beta)V_{C2} \ldots \quad (7)$$

Thus, if $V_A$ is within the range defined by the formula (7), good display can be effected.

Now, a maximum value of $V_A$ allowing good display is denoted by Vmax and a minimum value of $V_A$ is denoted by Vmin, and a factor M2 indicating a drive margin is denoted by the following formula:

$$M2=(Vmax-Vmin)/(Vmax+Vmin) \ldots (8)$$

The value of M2×100 represents a percentage fluctuation of voltage causing violation out of the drive margin Further, the value also provides an indication of up to what percentage of cell thickness fluctuation can be tolerated over the entire panel extension in case of a large panel Of course, a larger M2 represents a broader drive margin and is preferred.

In case of inversion from U2 state formed in advance to U1 state, M2 is given from formulae (7) and (8) as follows:

$$M2=(2-\alpha\beta(\gamma-1)/(2+\alpha\beta(\gamma+1) \ldots \quad (9).$$

Incidentally, it is preferred to set a bias ratio of $1/(\alpha\beta+2)$ in this case.

On the other hand, in the case where the liquid crystal is placed in U1 state, it is required that the liquid crystal is inverted to U2 by a voltage $V_B$ and not inverted to any of U1 and U2. Accordingly, the following relationship should be satisfied:

$$V_A \geqq V_{A2},\ V_B \leqq V_{B2},\ V_C \leqq V_{C2} \ldots \quad (10).$$

From formulae (4) and (10), $$V_{A2} \leqq V_A \leqq V_{B2} + 2V_{C2} \ldots \quad (11).$$

Further, from formulae (1), (2), (2') and (11), $$\beta\gamma V_{C2} \leqq V_A \leqq (2+\beta)V_{C2} \ldots \quad (12).$$

If the $V_A$ is within the range specified above, a good display can be effected.

Accordingly, in case of inversion from U1 state formed in advance to U2 state, a drive margin M2' is given from formulae (8) and (12) as follows:

$$M2'=(2-\beta(\gamma-1))/(2+\beta(\gamma+1)) \ldots \quad (13).$$

Incidentally, it is preferred to set a bias ratio to $1/(\beta+2)$ in this case.

When the formulae (9) and (13) are compared with each other, a relation of M2<M2' is found since $\alpha>1$, $\beta \geqq 1$ and $\gamma \geqq 1$. That is, a larger drive margin is attained in the case where the liquid crystal (or pixel) is first reset to U1 state and then inverted to U2 state depending on the given data signal.

In the driving method according to the present invention developed by taking the above factors into consideration, the pixels are first reset into the above mentioned first stable state (U1 state) and then inverted into the above-mentioned second stable state (U2 state) depending on given display data, whereby a broader drive margin is accomplished in a liquid crystal device having two stable states showing an asymmetrical threshold characteristic.

Hereinbelow, the present invention will be described based a specific embodiment.

Embodiment

A liquid crystal display device having a structure as illustrated in FIGS. 5 and 6 and having 1280×1024 pixels was prepared and driven according to the method of the present invention.

More specifically, the device was prepared in the following manner.

A pair of glass substrates each having 70 nm-thick ITO (indium-tin-oxide) transparent stripe electrodes formed by sputtering and coated with a 120 nm-thick TaO (tantalum oxide) film as an insulating film were provided. One of the substrates was further coated with a 1 wt. % solution of a polyamic acid (polyimide precursor) ("LP-64", mfd. by Toray K.K.) in a mixture solvent of NMP (N-methylpyrrolidone)/n-BC (n-butyl cellosolve) (=2/1) by spin coating at 45 r/s for 20 sec. The coated substrate was subjected to solvent evaporation for 5 min. in an oven at 80° C. and hot-baked for 1 hour in an oven at 200° C. to form a ca. 10 nm-thick polyimide film, which was then rubbed under a condition of providing a pretilt angle of 1 degree to form an alignment film. More specifically, the rubbing was performed by using a nylon cloth wound about a 10 cm-dia. roller under the conditions of 16.7 r/s, a cloth pressing depth of 0.4 mm and a substrate feed rate of 10 mm/sec. The rubbing was performed two times in the same direction (one way). Onto the substrate, spacer beads were dispersed at a density of ca. $300/mm_2$.

The other substrate having the ITO stripes and insulating TaO film was subjected to a homeotropic aligning treatment by applying a 0.5 wt. % solution of silane coupling agent ("ODS-E") in ethyl alcohol by spin coating at 45 r.p.s., for 20 sec. Onto the peripheral side of this substrate, a thermosetting sealant was applied by printing.

The thus-treated two substrates were disposed opposite to and applied to each other and heat-set in an oven at 150° C. for 90 min. to form a blank cell.

The cell was filled with a liquid crystal mixture having a composition shown below and heated to its isotropic temperature (100° C.) and then gradually cooled to SmC* phase.

The liquid crystal mixture was prepared by mixing the following compounds in the respectively indicated proportions.

5 wt %

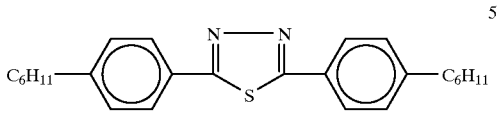

5 wt %

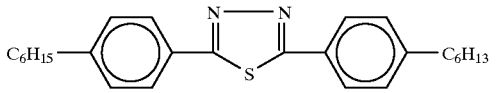

-continued 6.7 wt %

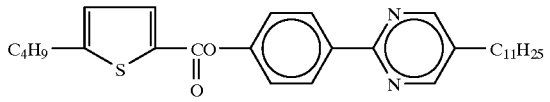

3.3 wt %

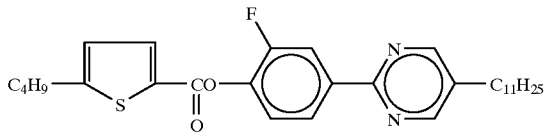

20 wt %

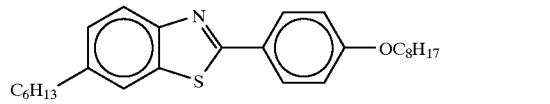

26 wt %

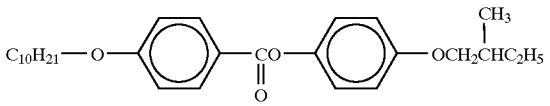

10 wt %

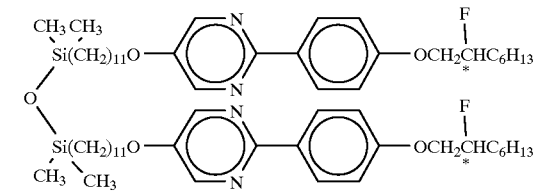

4 wt %

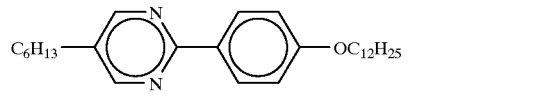

8 wt %

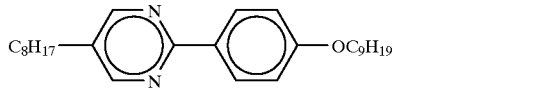

8 wt %

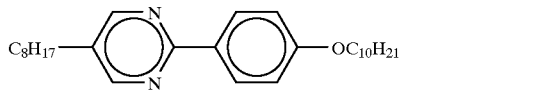

4 wt %

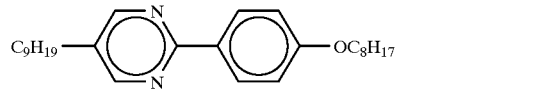

The liquid crystal mixture showed a phase transition series shown below and physical properties at 30° C. including a spontaneous polarization Ps=2.5 nC/cm$^2$, a cone angle Ⓗ=12.2 degrees, a dielectric anisotropy $\Delta\epsilon$ of ca. 0, and a tilt angle $\theta$=10.8 degrees when contained in the above cell.

$$\text{Iso.} \xrightarrow[79.0^\circ\text{ C.}]{} \text{SmA} \xrightarrow[53.2^\circ\text{ C.}]{} \text{Sm*C} \xrightarrow[-13.6^\circ\text{ C.}]{} \text{Crystal.}$$

Unlike a conventional chiral smectic C-phase liquid crystal showing a bent layer structure (chevron structure), the above liquid crystal mixture contained in the cell showed a so-called bookshelf structure free from bending and showed bistable two states.

The two stable states formed in the liquid crystal display device of this Embodiment showed an asymmetrical threshold similar to the one shown in FIG. 8.

Figure 9:
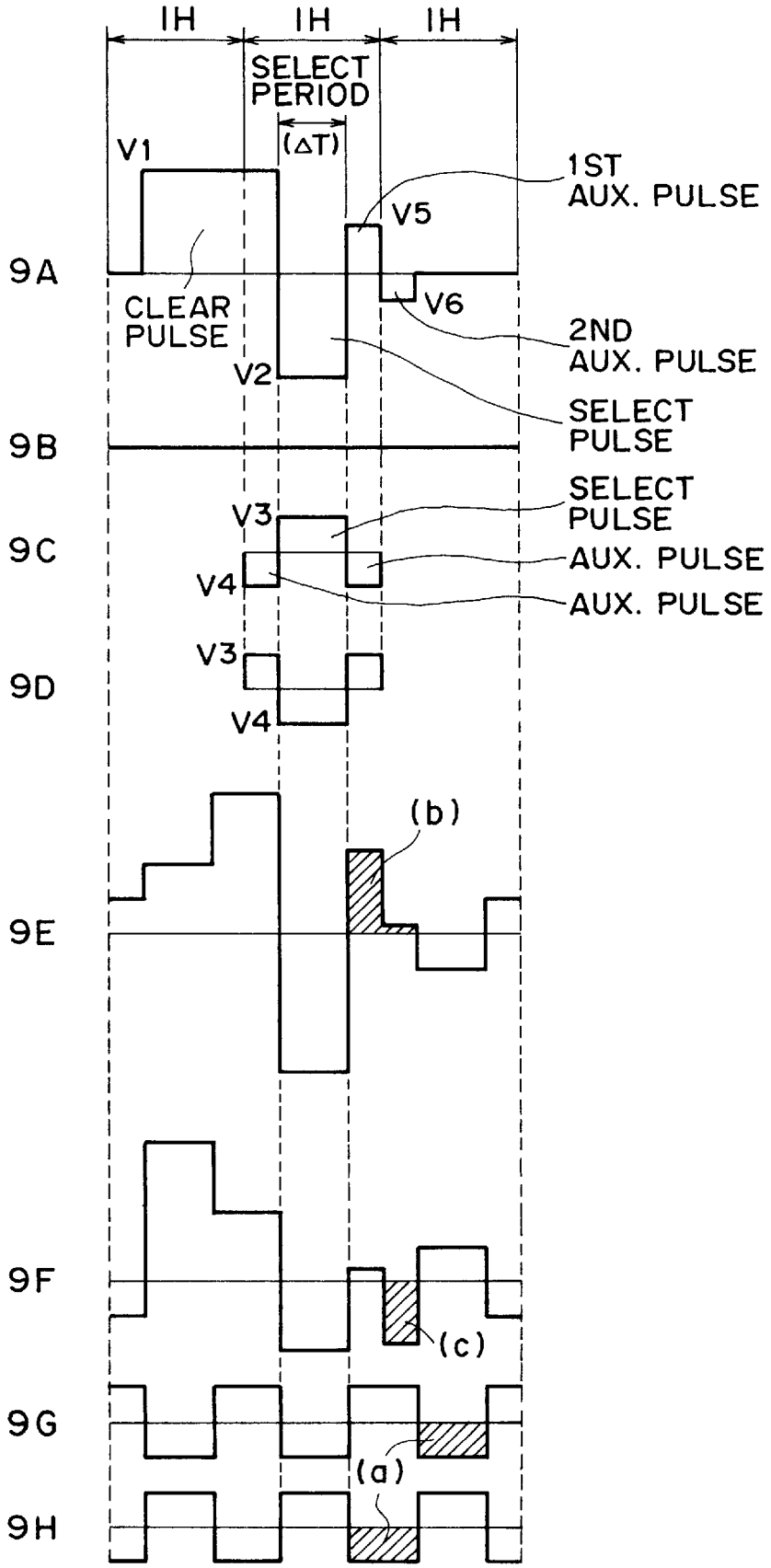
FIGS. 9–11 are waveform diagrams each showing a set of drive waveforms used in an embodiment of the invention.

In this embodiment, the liquid crystal display device 101 was subjected to a matrix drive by applying a set of drive signals shown in FIG. 9. Referring to FIG. 9, at 9A is shown a scanning selection signal; 9B, a scanning non-selection signal; 9C, a data signal for providing a bright display state; 9D, a data signal for providing a dark display state; 9E, a combined voltage signal (9A–9C) applied to a pixel for displaying "bright"; 9F, a combined voltage signal (9A–9D) applied to a pixel for displaying "dark"; and 9G and 9H, combined voltage signals (9B–9C and 9B–9D, respectively) applied to pixels at the time of non-selection.

In this embodiment shown in FIG. 9, the scanning selection signal at 9A had a clear (reset) pulse V1=14.3 volts, a selection pulse V2=−14.3 volts, a first auxiliary pulse $V_5$=6.3 volts and a second auxiliary pulse $V_6$=−5.1 volts. The data signals at 9C and 9D included pulses $V_3$=5.7 volts and $V_4$=−5.7 volts. The selection period $\Delta T$ was set to 30 $\mu$psec.

In this embodiment, a matrix drive was performed so that the pixels were reset into U1 state and then selectively inverted to U2 state depending on given display data, whereby a good binary display was performed by using the display device of this Embodiment having a cell thickness distribution of 1.9–2.0 $\mu$m over the entire display area such that the cell thickness was larger in the neighborhood of the sealant than the other part.

For the purpose of comparison, the same display device was driven according to a matrix drive scheme wherein the pixels were reset into U2 state and then selectively inverted into U1 state depending on given display data, whereby U1 state failed to be displayed in the neighborhood of the sealant and U2 state (black state) formed in the center of the display area showed a relatively high brightness, thus providing a lower contrast.

The scanning selection signal shown at 9A of FIG. 9 used in this embodiment included two auxiliary pulses V5 and V6. This is based on the following reason.

Figure 10:
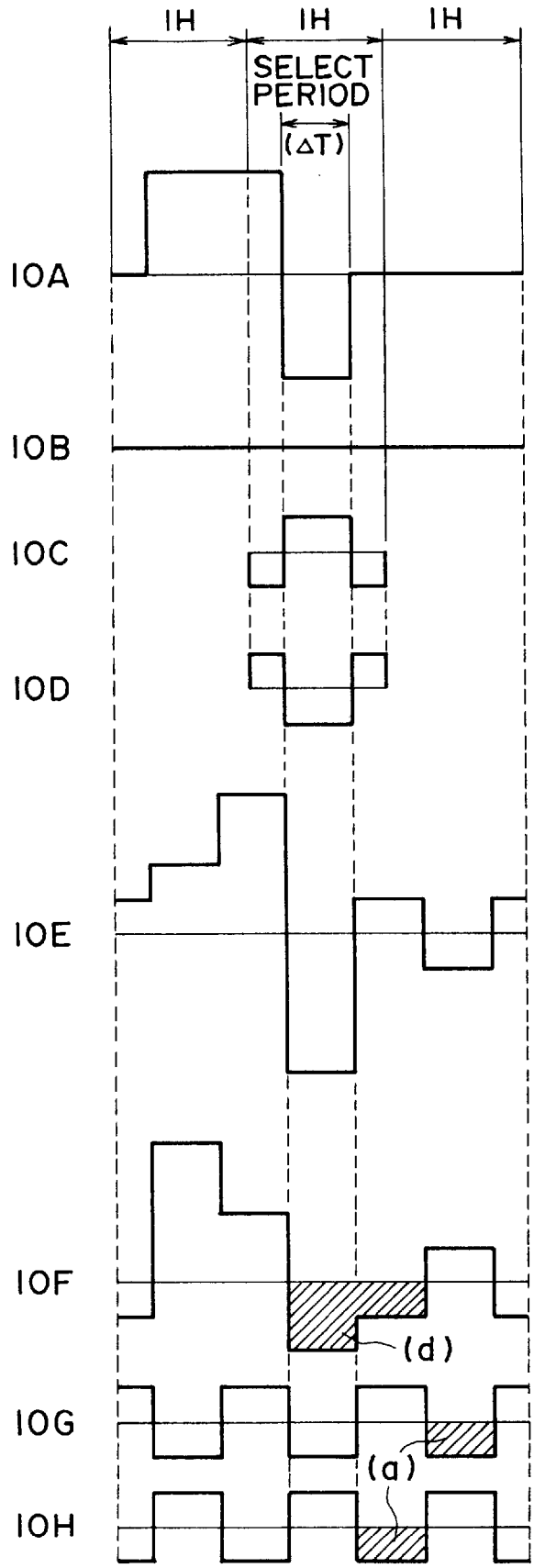
Figure 11:
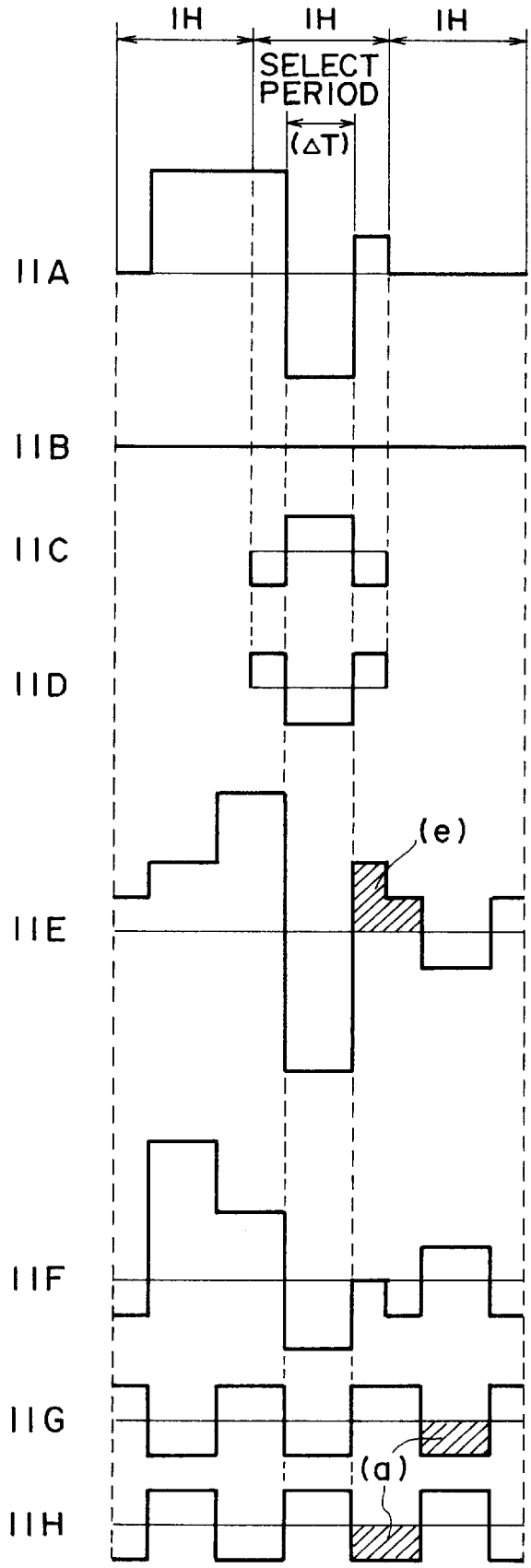

For comparison with the above embodiment, FIG. 10 shows a scanning selection signal including no auxiliary pulse and FIG. 11 shows a scanning selection signal including one auxiliary pulse.

When a data signal is composed by a selection pulse and two auxiliary pulses disposed before and after the selection pulse, and data signals are applied consecutively, a pulse (d) at 10F of FIG. 10 and a pulse (e) at 11E of FIG. 11 respectively preceding an AC pulse at the time of non-selection has a larger product of a voltage and pulse width (effective value) than pulses (a) applied to other pixels (liquid crystal) in the waveforms (at 10G, 10H, 11G, 11H) at the time of non-selection, so that the pulses (d) and (e) are liable to cause an inversion of liquid crystal molecules more quickly than the pulses (a), thus narrowing the drive margin to some extent.

Accordingly, in the present invention, in order to prevent an inversion of liquid crystal molecules due to an auxiliary pulse in data signals, it is preferred that a scanning selection signal includes, in addition to a clear pulse and a selection pulse, a first auxiliary pulse having the same polarity as the clear pulse and an amplitude larger than that of the data signal, and a second auxiliary signal having the same polarity as the selection pulse and an amplitude smaller than that of the data signal.

More specifically, in this embodiment, a scanning selection signal was provided with two auxiliary pulses so that pulses (b) and (c) have effective values nearly equal to that of pulses (a). More strictly, in view of the fact that U2 state was more stable than U1 state, the values $V_3$, $V_4$, $V_5$ and $V_6$ were set so that the pulse (b) had a slightly smaller effective value and the pulse (c) had a slightly smaller effective value, respectively, compared with the pulse (a).

Figure 12:
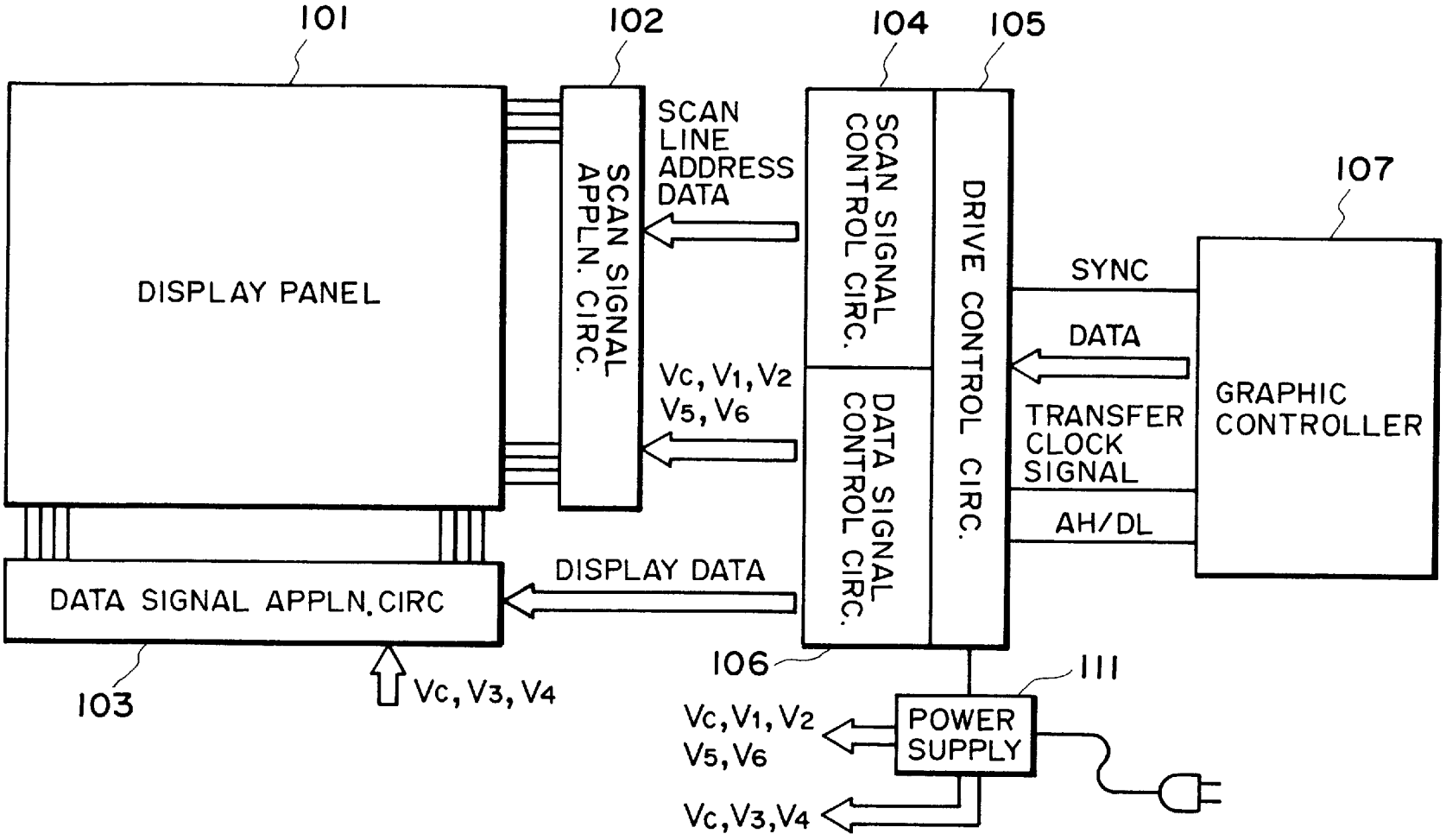
FIG. 12 is a block diagram of a liquid crystal display apparatus according to an embodiment of the invention.

FIG. 12 is a block diagram of a liquid crystal display apparatus, an embodiment of the liquid crystal apparatus according to the present invention. Referring to FIG. 12, the display apparatus includes a graphic controller 107, from which data are sent out via a drive control circuit 105 to a scanning signal control circuit 104 and a data signal control circuit 106, where the data are converted into address data and display data, respectively According to the address data, a scanning signal application circuit 102 generates a scanning selection signal waveform as shown at 9A in FIG. 9, which is applied to the scanning electrodes in the display device 101. On the other hand, according to the display data, a data signal application circuit 103 generates and applies data signal waveforms as shown at 9C and 9D in FIG. 9.

The apparatus is driven by a drive power supply 111 from which at least 7 reference voltages of $V_C$ and $V_1$–$V_6$ are supplied to the scanning signal application circuit 102 and the data signal application circuit. The reference voltages may be generated from a battery or an AC power supply.

As described above, according to the driving method of the present invention, a liquid crystal device having an asymmetrical threshold characteristic can be driven at a broader drive margin in a matrix drive to provide a good display over an entire display area.

What is claimed is:

1. A driving method for a binary display-type liquid crystal device comprising an electrode matrix including a group of scanning electrodes and a group of data electrodes and a chiral smectic liquid crystal disposed between the scanning electrodes and the data electrodes so as to form a pixel at each intersection of the scanning electrodes and the data electrodes, the liquid crystal being aligned to assume two stable states, under no electric field, corresponding to a bright state and a dark state of each pixel and having a threshold characteristic of Va<Vb wherein Va denotes an electric field intensity of one polarity required for switching from a first stable state to a second stable state, and Vb denotes an electric field intensity of the other polarity required for switching from the second stable state to the first stable state, said driving method comprising:

sequentially applying a scanning selection signal to the scanning electrodes, and applying data signals based on display data to the data electrodes in synchronism with the scanning selection signal, wherein the scanning selection signal includes a clearing pulse for resetting the liquid crystal to the first stable state regardless of given display data, and a selection pulse for switching the liquid crystal to the second stable state selectively depending on given display data, the clearing pulse being free from an AC component during one selection period for a scanning electrode, the scanning selection signal further including an auxiliary pulse having a polarity opposite to that of the selection pulse for retaining a stable state at an associated pixel subsequent to the selection pulse, wherein the scanning electrodes and data electrodes are disposed on a pair of substrates, respectively, one of the substrates is provided with an alignment film having a non-uniaxial alignment characteristic, and the other of the substrates is provided with an alignment film subjected to a uniaxial aligning treatment.

2. A method according to claim 1, wherein the chiral smectic liquid crystal has a phase transition of isotropic, smectic A and chiral smectic, successively, on temperature decrease.

3. A liquid crystal apparatus, comprising:

a binary display-type liquid crystal device comprising an electrode matrix including a group of scanning electrodes and a group of data electrodes and a chiral smectic liquid crystal disposed between the scanning electrodes and the data electrodes so as to form a pixel at each intersection of the scanning electrodes and the data electrodes, said liquid crystal being aligned to assume two stable states, under no electric field, corresponding to a bright state and a dark state of each pixel and having a threshold characteristic of Va<Vb, wherein Va denotes an electric field intensity of one polarity required for switching from a first stable state to a second stable state, and Vb denotes an electric field intensity of the other polarity required for switching from the second stable state to the first stable state; and driving means for sequentially applying a scanning selection signal to the scanning electrodes, and applying data signals based on display data to the data electrodes in synchronism with the scanning selection signal; wherein said scanning selection signal includes a clearing pulse for resetting the liquid crystal to the first stable state regardless of given display data, and a selection pulse for switching the liquid crystal to the second stable state selectively depending on given display data, said clearing pulse being free from an AC component during one selection period for a scanning electrode, the scanning selection signal further including an auxiliary pulse having a polarity opposite to that of the selection pulse for retaining a stable state at an associated pixel subsequent to the selection pulse, wherein said scanning electrodes and data electrodes are disposed on a pair of substrates, respectively, one of said substrates is provided with an alignment film having a non-uniaxial alignment characteristic, and the other of said substrates is provided with an alignment film subjected to a uniaxial aligning treatment.

4. A driving method for a binary display-type liquid crystal device comprising an electrode matrix including a group of scanning electrodes and a group of data electrodes and a chiral smectic liquid crystal disposed in a planar smectic layer structure between the scanning electrodes and the data electrodes so as to form a pixel at each intersection of the scanning electrodes and the data electrodes, the liquid crystal being aligned to assume two stable states, under no electric field, corresponding to a bright state and a dark state of each pixel and having a threshold characteristic of Va<Vb, wherein Va denotes an electric field intensity of one polarity required for switching from a first stable state to a second stable state, and Vb denotes an electric field intensity of the other polarity required for switching from the second stable state to the first stable state, said driving method comprising:

sequentially applying a scanning selection signal to the scanning electrodes, and applying data signals based on display data to the data electrodes in synchronism with the scanning selection signal, so that the liquid crystal is first reset into the first stable state regardless of given display data and then selectively switched to the second stable state depending on given display data, the scanning selection signal further including an auxiliary pulse having a polarity opposite to that of the selection pulse for retaining a stable state at an associated pixel subsequent to the selection pulse, wherein the scanning electrodes and data electrodes are disposed on a pair of substrates, respectively, one of the substrates is provided with an alignment film having a non-uniaxial alignment characteristic, and the other of the substrates is provided with an alignment film subjected to a uniaxial aligning treatment.

5. A method according to claim 4, wherein the scanning selection signal includes a clearing pulse for resetting the liquid crystal to a first stable state regardless of given display data, a selection pulse for switching the liquid crystal to the second stable state selectively depending on given display data, a first auxiliary pulse having the same polarity as the clearing pulse and an amplitude larger than that of a data signal, and a second auxiliary signal having the same polarity as the selection pulse and an amplitude smaller than that of a data signal, the clearing pulse being free from an AC component during one selection period for a scanning electrode.

6. A method according to claim 4, wherein the chiral smectic liquid crystal has a phase transition of isotropic, smectic A and chiral smectic, successively, on temperature decrease.

7. A liquid crystal apparatus, comprising:

a binary display-type liquid crystal device comprising an electrode matrix including a group of scanning electrodes and a group of data electrodes and a chiral smectic liquid crystal disposed in a planar smectic layer structure between the scanning electrodes and the data electrodes so as to form a pixel at each intersection of the scanning electrodes and the data electrodes, said liquid crystal being aligned to assume two stable states, under no electric field, corresponding to a bright state and a dark state of each pixel and having a threshold characteristic of $Va<Vb$, wherein Va denotes an electric field intensity of one polarity required for switching from a first stable state to a second stable state, and Vb denotes an electric field intensity of the other polarity required for switching from the second stable state to the first stable state; and driving means for sequentially applying a scanning selection signal to the scanning electrodes, and applying data signals based on display data to the data electrodes in synchronism with the scanning selection signal, so that the liquid crystal is first reset into the first stable state regardless of given display data and then selectively switched to the second stable state depending on given display data, the scanning selection signal further including an auxiliary pulse having a polarity opposite to that of the selection pulse for retaining a stable state at an associated pixel subsequent to the selection pulse, wherein said scanning electrodes and data electrodes are disposed on a pair of substrates, respectively, one of said substrates is provided with an alignment film having a non-uniaxial alignment characteristic, and the other of said substrates is provided with an alignment film subjected to a uniaxial aligning treatment.

* * * * *

UNITED STATES PATENT AND TRADEMARK OFFICE

CERTIFICATE OF CORRECTION

PATENT NO. : 5,943,035

DATED : August 24, 1999

INVENTOR(S) : KAZUNORI KATAKURA

It is certified that error appears in the above-identified patent and that said Letters Patent is hereby corrected as shown below:

IN THE TITLE PAGE [56] References Cited

FOREIGN PATENT DOCUMENTS,

| | |
|---|---|
| "1160986" should read | --1-160986--. |
| 1193390 | 1-193390 |
| 04043321 | 4-043321 |

COLUMN 3

Line 48, "layer than" should read --larger than--.

COLUMN 4

Line 43, "state" (1st occurrence) should read --state.--; and
Line 46, "etch," should read --etc.--.

COLUMN 5

Line 28, "respectively" should read --respectively.--.

COLUMN 6

Line 13, "plastic" should read --plastic.--; and
Line 28, "results" should read --result--.

COLUMN 7

Line 1, "oblique.." should read --oblique--;
Line 46, "aligning" should read --align--; and
Line 59, "experiments" should read --experiments.--.

UNITED STATES PATENT AND TRADEMARK OFFICE

CERTIFICATE OF CORRECTION

PATENT NO. : 5,943,035

DATED : August 24, 1999

INVENTOR(S) : KAZUNORI KATAKURA

It is certified that error appears in the above-identified patent and that said Letters Patent is hereby corrected as shown below:

COLUMN 9

Line 3, "Formulae" should read --formulae--;
Line 10, "Now," should read --¶ Now,--;
Line 18, "margin" should read --margin.--; and
Line 21, "panel" (2nd occurrence) should read --panel.--.

COLUMN 10

Line 64,

" 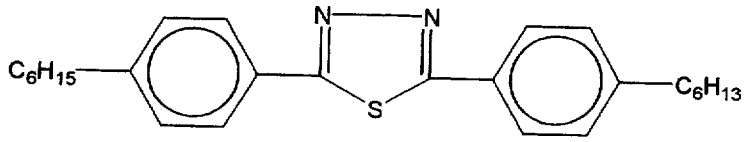 "

should read

-- 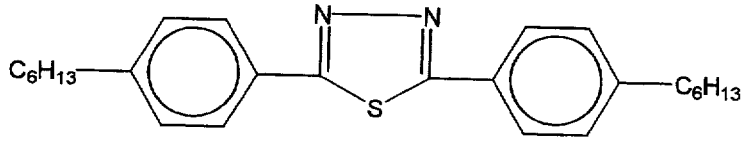 --.

UNITED STATES PATENT AND TRADEMARK OFFICE

CERTIFICATE OF CORRECTION

PATENT NO. : 5,943,035

DATED : August 24, 1999

INVENTOR(S) : KAZUNORI KATAKURA

It is certified that error appears in the above-identified patent and that said Letters Patent is hereby corrected as shown below:

COLUMN 11

Line 5,

" 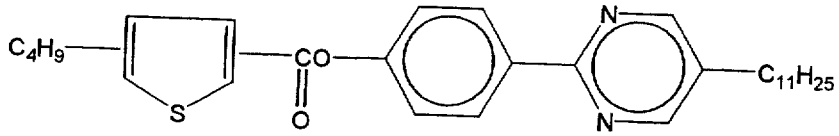 "

should read

-- 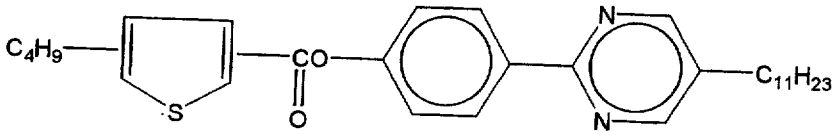 --;

and

Line 12,

" 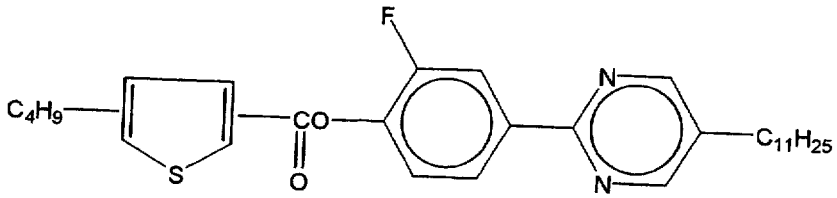 "

should read

-- 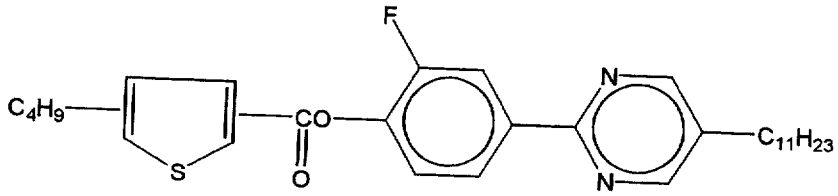 --.

UNITED STATES PATENT AND TRADEMARK OFFICE

CERTIFICATE OF CORRECTION

PATENT NO. : 5,943,035

DATED : August 24, 1999

INVENTOR(S) : KAZUNORI KATAKURA

It is certified that error appears in the above-identified patent and that said Letters Patent is hereby corrected as shown below:

COLUMN 13

Line 25, "respectively" should read --respectively.--.

Signed and Sealed this

Fifteenth Day of August, 2000

*Attest:*

*Attesting Officer*

Q. TODD DICKINSON

*Director of Patents and Trademarks*